US009636679B2

(12) United States Patent
Fournier et al.

(10) Patent No.: US 9,636,679 B2
(45) Date of Patent: May 2, 2017

(54) CAP FOR SEALING A CONTAINER

(75) Inventors: Laurent Fournier, Versailles (FR); Gilles Venturi, Magny-les-Hameaux (FR)

(73) Assignee: BIO-RAD INNOVATIONS, Marnes la Coquette (FR)

( * ) Notice: Subject to any disclaimer, the term of this patent is extended or adjusted under 35 U.S.C. 154(b) by 383 days.

(21) Appl. No.: 13/996,447

(22) PCT Filed: Dec. 20, 2011

(86) PCT No.: PCT/EP2011/073460

§ 371 (c)(1),
(2), (4) Date: Oct. 11, 2013

(87) PCT Pub. No.: WO2012/084989

PCT Pub. Date: Jun. 28, 2012

(65) Prior Publication Data

US 2014/0041758 A1 Feb. 13, 2014

Related U.S. Application Data

(60) Provisional application No. 61/452,426, filed on Mar. 14, 2011.

(30) Foreign Application Priority Data

Dec. 21, 2010 (FR) ..... 10 60947

(51) Int. Cl.
*B01L 3/00* (2006.01)
*B65D 47/20* (2006.01)

(52) U.S. Cl.
CPC ..... *B01L 3/523* (2013.01); *B01L 3/50825* (2013.01); *B65D 47/2018* (2013.01); *B01L 2300/044* (2013.01)

(58) Field of Classification Search
CPC ..... B01L 3/523; B01L 3/50825; B01L 2300/044; B65D 47/2018
(Continued)

(56) References Cited

U.S. PATENT DOCUMENTS 4,515,752 A * 5/1985 Miramanda ..... 422/568
5,342,315 A * 8/1994 Rowe ..... A61B 17/3462 604/167.06

(Continued)

FOREIGN PATENT DOCUMENTS

EP 0 794 129 A1 9/1997
WO WO 90/09330 A1 8/1990
WO WO 92/20449 A1 11/1992

OTHER PUBLICATIONS

International Search Report and Written Opinion for corresponding International Application No. PCT/EP2011/073460, mailed on Apr. 5, 2012, 11 pages.

*Primary Examiner* — Mark A Laurenzi
*Assistant Examiner* — James Hakomaki
(74) *Attorney, Agent, or Firm* — Bookoff McAndrews, PLLC

(57) ABSTRACT

The present invention relates to a cap comprising a body, an opening passing through the cap and adapted in turn to be passed through by at least one product transfer member, and a membrane which, at rest, covers the opening. The membrane has a main portion that extends through the opening and defines two inclined faces, each inclined face having a distal edge. The two inclined faces form a dihedron when the membrane is at rest, the distal edges of the two inclined faces coming together at the apex of the dihedron. The cap comprises at least two flaps that extend through the opening, above the membrane, the two inclined faces of the membrane being respectively covered by two flaps, each flap
(Continued)

having a free edge that extends along the distal edge of the corresponding inclined face.

12 Claims, 4 Drawing Sheets

(58) Field of Classification Search
USPC ..... 141/349, 330; 220/303; 604/167.03, 604/185; 606/167
See application file for complete search history.

(56) References Cited

U.S. PATENT DOCUMENTS 5,342,316 A * 8/1994 Wallace ..... A61M 39/045 137/845
5,628,732 A * 5/1997 Antoon et al. ..... 604/167.06
6,258,065 B1 * 7/2001 Dennis ..... A61B 17/3462 604/167.01
6,716,396 B1 * 4/2004 Anderson ..... B01L 3/0275 215/232
7,163,525 B2 * 1/2007 Franer ..... 604/167.03
8,430,812 B2 * 4/2013 Barnes ..... A61B 17/3462 600/205
2004/0067169 A1 * 4/2004 Krause ..... B01L 3/022 422/513
2004/0230161 A1 * 11/2004 Zeiner ..... 604/167.06
2005/0033342 A1 * 2/2005 Hart ..... A61B 17/3462 606/185
2007/0023430 A1 * 2/2007 Seher ..... A61J 1/1406 220/200
2008/0171988 A1 * 7/2008 Blanco ..... A61B 17/3462 604/167.03
2008/0249475 A1 * 10/2008 Albrecht ..... A61B 17/3498 604/167.06
2008/0251490 A1 10/2008 Livingston et al.
2009/0093682 A1 * 4/2009 Izzo ..... A61B 17/3462 600/201
2009/0270681 A1 * 10/2009 Moreno ..... A61B 17/3462 600/155
2009/0270685 A1 * 10/2009 Moreno ..... A61B 17/3498 600/203

* cited by examiner

CAP FOR SEALING A CONTAINER

CROSS-REFERENCE TO RELATED APPLICATIONS

This application is a National Stage filing under 35 U.S.C. §371 of International Application No. PCT/EP2011/073460, filed Dec. 20, 2011, which claims the benefit of French patent application no. Patent Application No. 1060947, filed Dec. 21, 2010, and U.S. Provisional Application No. 61/452,426, filed Mar. 14, 2010, the entirety entireties of which are herein incorporated by reference.

FIELD OF THE INVENTION

The present disclosure relates to a cap for sealing a container. Such a cap can be used to close any type of container, and in particular a container containing a reagent.

BACKGROUND OF THE INVENTION

In the field of laboratory analyses (chemical, biological, biochemical, immunochemical, etc.), machines that perform all or part of the analysis operations are used more and more frequently. These machines generally use containers containing the reagents necessary for the analysis reactions.

To maintain the stability of a reagent, in particular a biological reagent, the reagent should be confined in a container from its manufacture to use. That container must be as sealed as possible so as to avoid, in particular, the contamination of the reagent, the evaporation of the solvent contained in the reagent if it is liquid, or the untimely entry of water into the reagent if it is lyophilized.

To that end, special seals have been developed to sealably close a container containing a reagent, while allowing an analysis machine to easily access the reagent.

In particular, the PCT application published under number WO 2008/130929 discloses a system with a special cap comprising a body screwed on the container, an opening passing through the body, and a pierceable membrane that covers the opening. In this system, a disposable pipette tip borne by an analysis machine pierces the membrane and passes through it to remove the reagent contained in the container. However, several problems may arise with such a system.

First, it may be difficult, or even impossible, to pierce the membrane, either because the tip is poorly positioned relative to the membrane, or because the tip twists, bends, or breaks in contact with the membrane.

Then, the tip may remain stuck in the membrane due to the friction existing between the tip and the membrane. In that case, the user is required to stop the machine to recover the tip.

Lastly, when the tip does not remain stuck in the membrane, it may bring the membrane with it when it is removed, also due to the friction existing between the tip and the membrane. This deforms the membrane and prevents it from "closing" correctly once the tip is removed. The sealing of the container and the lifetime of the reagent are affected by this.

There is therefore a need for a solution making it possible to resolve at least one of the aforementioned problems, if only in part.

BRIEF DESCRIPTION OF THE INVENTION

The present disclosure relates to a cap comprising: a body, an opening passing through the cap and adapted in turn to be passed through by at least one product transfer member, and a membrane which, at rest, covers the opening. The membrane has a main portion that extends through the opening and defines two inclined faces, each inclined face having a distal edge, and the two inclined faces form a dihedron when the membrane is at rest, the distal edges of the two inclined faces coming together at the apex of the dihedron. This cap also comprises at least two flaps extending through the opening, above the membrane, the two inclined faces of the membrane being respectively covered by the two flaps, each flap having a free edge that extends along the distal edge of the corresponding inclined face, so that, when the transfer member passes through the opening and the membrane, the free edges of the two flaps respectively press along the distal edges of the two inclined faces.

The present description also relates to a system comprising such a cap and a container, the cap closing the container.

In certain embodiments, the system also comprises a product transfer member configured to pass through the opening and the membrane of the cap and to transfer a product from the inside toward the outside of the container, or vice versa. This transfer member can be a tip such as, for example, a pipette tip. This transfer member can be made from plastic, for example polypropylene. This transfer member can be disposable.

The membrane is said to be "at rest" when it is not stressed by the transfer member. This membrane can be made from an elastomer.

At rest, the two inclined faces of the membrane form a dihedron, the distal edges of the two inclined faces coming together at the apex of said dihedron. The angle of the dihedron may be comprised between 20 and 160°. Also, in cross-section in a plane perpendicular to the apex of the dihedron, the two inclined faces form a V whereof the tip is pointed downwards, i.e. towards the inside of the container. Such a configuration in particular makes it possible to guide the transfer member toward the apex of the dihedron when it is inserted and avoid deformation problems of the transfer member, as well as deformation problems of the membrane when the transfer member is removed, the membrane naturally tending to keep its V shape. Furthermore, the flaps prevent the membrane from turning around during removal of the transfer member, i.e. from going from its V shape pointing downward to its V shape pointing upward.

The flaps form favored contact areas with the transfer member, the transfer member being more in contact with the flaps than with the membrane. This minimizes contact between the transfer member and the membrane, and therefore decreases the risk of the transfer member remaining stuck in the membrane, or having the membrane driven by the transfer member during the removal thereof.

The flaps can be made from a rigid material and, for example, a rigid plastic such as a hard polypropylene.

In the event of poor relative positioning between the transfer member and the cap, the transfer member comes into contact with one of the flaps and slides thereon until it reaches the apex of the dihedron. The flaps therefore make it possible to guide the transfer member toward the apex of the dihedron.

Both during insertion and removal of the transfer member, the free edges of the two flaps respectively press along the distal edges of the two inclined faces. This makes it possible to move the distal edges apart while limiting their deformation as much as possible and, in particular, their curvature. In this way, once the transfer member is removed, these distal edges more easily return to their original shape (i.e. the shape they had at rest) and come closer to one another (ideally come into contact with one another) over their entire length, which makes it possible to guarantee the best possible sealing, until the next use of the container.

As indicated, the free edge of a flap extends along the distal edge of the corresponding inclined face, i.e. it follows that distal edge while staying close to it. This makes it possible to distribute the forces exerted by the transfer member on the length of the distal edge rather than concentrating those forces on a given point. Such a distribution of the forces along the length of the distal edge is interesting during the insertion of the transfer member because it makes it possible for the membrane to open cleanly, along the apex of the dihedron.

In certain embodiments, the membrane is pierceable and/or tearable, and said distribution of the forces makes it possible to tear the membrane cleanly along the apex of the dihedron.

The fact that the free edges of the flaps extend along the distal edges of their respective inclined faces also allows the membrane to open widely along the apex of the dihedron, when it is passed through by the transfer member. In this way, the transfer member can enter the container while allowing air to escape on either side of the transfer member. This makes it possible to avoid creating an overpressure in the container, such an overpressure risking spreading part of the contents of the container outside. Furthermore, when the transfer member is used to suction the contents of the container or when the transfer member is out of the container, air can enter the container on either side of the transfer member. This makes it possible to avoid creating a vacuum in the container that would risk facilitating the entry of outside contaminants. The proposed configuration therefore allows air to enter and exit during transfer operations so as not to create an overpressure/vacuum in the container.

In certain embodiments, the transfer member has a transverse section with a width smaller than the length of the distal edges of the inclined faces, and the free edges of the flaps have a length comprised between the width of the transverse section and the length of the distal edges. Such a configuration reinforces the aforementioned advantages by allowing better distribution of forces along the length of the distal edge and wide opening of the membrane, along the apex of the dihedron, when it is passed through by the transfer member.

Each flap has a lower surface facing the membrane and an upper surface opposite the lower surface. In certain embodiments, each flap has, on its upper surface, an overthickness that extends along the free edge of the flap.

In addition to strengthening the free edge, such an overthickness makes it possible to create a favored, or even practically exclusive, contact area with the transfer member, the transfer member coming into little or no contact with other parts of the flap or with the membrane, when it passes through the opening. This contact area having a limited surface, the friction between the transfer member and the cap is further decreased. The risk of the transfer member sticking in the cap is therefore further decreased.

In certain embodiments, the overthickness is formed by a rib or a bead.

In certain embodiments, the overthickness is formed by a portion of the flap whereof the thickness increases continuously as one comes closer to the free edge. This configuration makes it possible to avoid creating a stop on the upper surface of the flap, because such a stop would risk opposing sliding of the transfer member on the upper surface of the flap, when said member is inserted into the cap.

Each flap has a lower surface facing the membrane and an upper surface opposite the lower surface. In certain embodiments, each flap has protuberances or cavities on/in its lower surface, said protuberances or cavities being housed in cavities or protuberances with complementary shapes provided in/on the inclined faces of the membrane. The cooperation of the protuberances and cavities makes it possible to physically connect the flap to the membrane, and to thereby ensure that the movement of the flap follows that of the membrane and vice versa.

It will be noted that the opening of the cap extends axially between an intake orifice and the main membrane portion, and that the apex of the dihedron has a central portion and two opposite ends, situated on either side of the central portion. In certain embodiments, the cap comprises two guide elements respectively extending between the intake orifice and the two ends of the apex, at the periphery of the opening. These two guide elements make it possible to guide the transfer member toward the central part of the apex of the dihedron and to prevent, in particular, the transfer member from passing through the membrane at said opposite ends.

In certain embodiments, the body of the cap, the flaps and/or the guide elements are made in a single piece. For example, they can be made from plastic, by molding.

In certain embodiments, the membrane is made from a first material and the flaps from a second material that is more rigid than the first material. For example, the first material is a flexible elastic material, e.g. an elastomer, while the second material is a hard plastic.

In certain embodiments, the membrane is made from a first material and the flaps from a second material, different from the first material and such that the coefficient of friction of the transfer member on the second material is lower than the coefficient of friction of the transfer member on the first material. This further minimizes the friction between the transfer member and the cap, the transfer member being mostly in contact with the flaps. The risk of the transfer member sticking in the cap is thus decreased.

In certain embodiments, the membrane is pierceable and/or tearable along the apex of the dihedron. Typically, the material and/or the thickness of the membrane along the apex of the dihedron are chosen so that the membrane is pierced and/or tears easily at that point.

In other embodiments, the membrane is pre-pierced or slitted along the apex of the dihedron. In the latter case, the membrane has a slit along the apex of the dihedron, at least in the central part of said apex. At rest, said slit has the smallest possible width, or even no width, so as to guarantee the best possible sealing.

Several embodiments or examples are described in this description. However, unless otherwise indicated, the characteristics described relative to any one embodiment or example can be applied to another embodiment or example.

BRIEF DESCRIPTION OF THE DRAWINGS

The appended drawings aim to illustrate the principles of the invention.

In the drawings, from one figure (FIG.) to the next, identical elements (or parts of elements) bear the same references. Additionally, elements (or parts of elements) belonging to different embodiments but having a similar function are referenced in the figures using numerical references spaced apart by 100, 200, etc.

DETAILED DESCRIPTION OF EXAMPLES

Several examples are described in detail below, in reference to the appended drawings. These examples illustrate the characteristics and advantages of the invention. It is, however, recalled that the invention is not limited to these examples.

Figure 1:
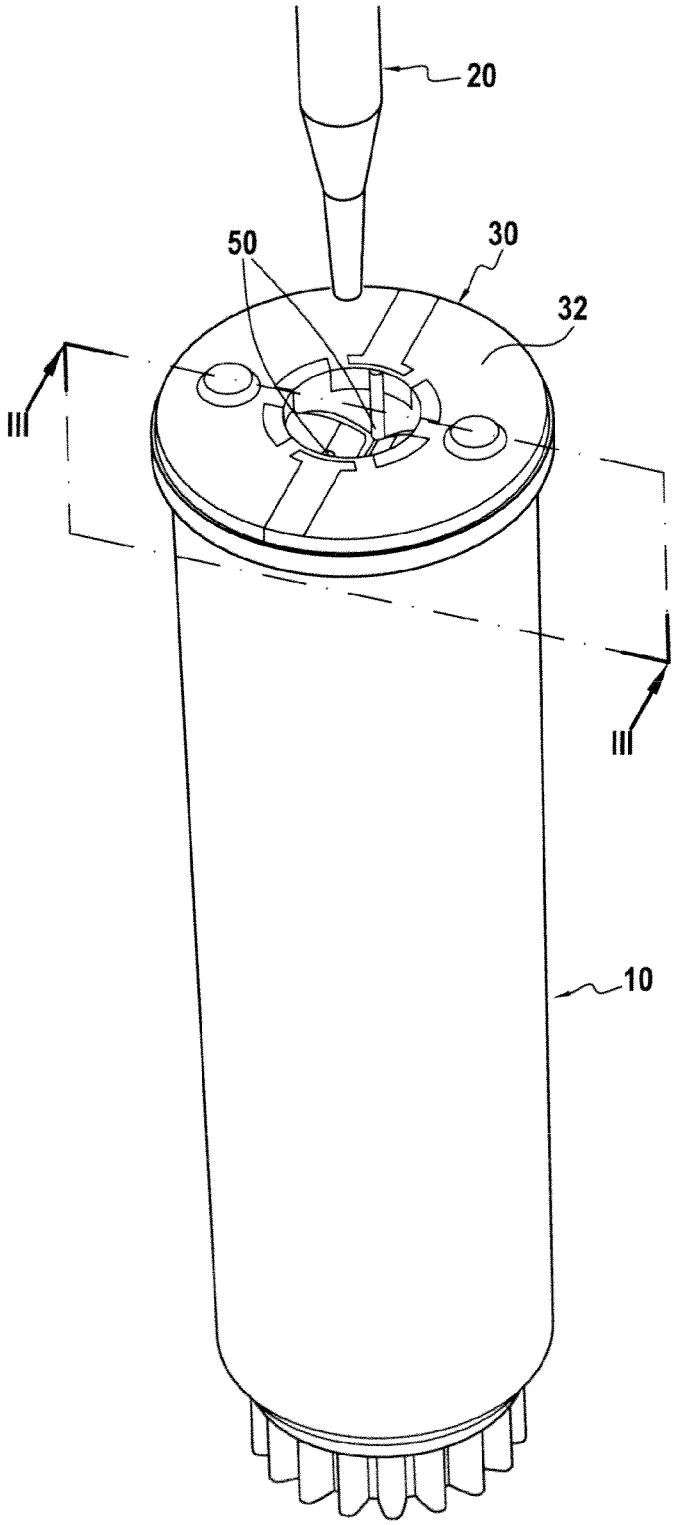
FIG. 1 shows, in perspective view, a container closed by a cap and a transfer member situated outside the container, above the cap.
Figure 2:
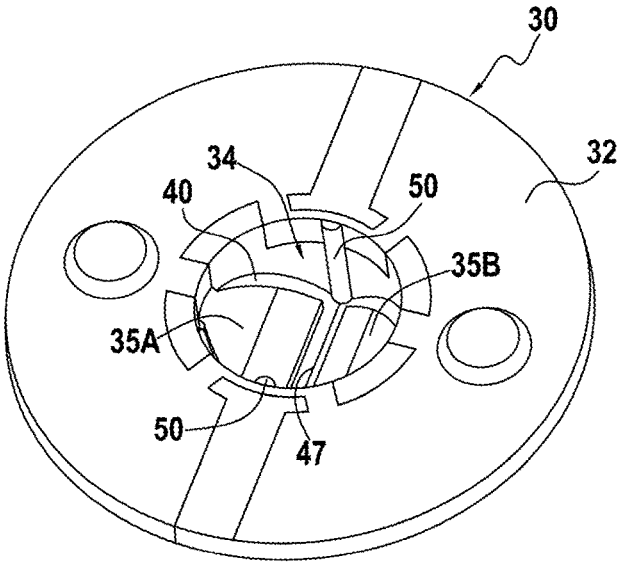
FIG. 2 shows the cap of FIG. 1 in perspective view.

FIG. 1 shows a container 10 closed by a cap 30 and a tip 20 situated outside the container 10, above the cap 30.

In this example, the container 10 is a container adapted to equip an automated analysis device (not shown). This container 10 contains a reagent, which is typically in liquid form. To analyze a sample, a particular quantity of reagent is taken from inside the container 10 via the tip 20. This quantity of reagent is then transported and placed in a reaction zone (for example a test tube or a well), where it is mixed with an aliquot of the sample to be analyzed, depending on the specifications of the analysis protocol.

In the analysis device, the container 10 is kept substantially vertical. The container 10 has a single opening in its upper portion, said opening being closed by the cap 30. To remove the reagent, the tip 20 must be lowered through the cap 30 until it reaches the reagent present in the bottom of the container 10. The level of reagent can be detected by the tip 20, for example, by modifying the capacity of the tip or by detecting a pressure change in the tip 20.

The tip 20 is one example of a transfer member within the meaning of the present invention. This tip 20 is connected to a pipette (not shown) of the analysis device, which is connected to a syringe making it possible to suction the reagent to the inside of the tip. The tip 20 is then moved by the machine, the reagent then being expelled from the tip 20 and deposited in the reaction zone. The tip 20 is disposable. It is thrown away after depositing the reagent in the reaction area, for example by applying a vertical force on the tip to separate it from the pipette, this force having to be greater than the frictional force between the tip and the apex of the pipette. The tip 20 is, for example, made from plastic.

Of course, the invention is not limited to the aforementioned embodiment and can be applied to any other type of container, irrespective of the contents thereof. Likewise, the tip 20 can be used no to remove, but to introduce a product into the container 10. Generally, it is a matter of transferring a product from the inside of the container 10 to the outside thereof, or vice versa.

In reference to FIGS. 2 to 5, the cap 30 comprises a body 32. In the illustrated example, said body 32 is welded on the container 10 using any known means such as laser welding, infrared welding, ultrasound welding, welding using welding tools, the important point being to guarantee maximum sealing in the weld zone. In other examples, the body 32 is adhered or screwed on the container 10. In the latter case, the body 32 and the container 10 have complementary threads.

Figure 3:
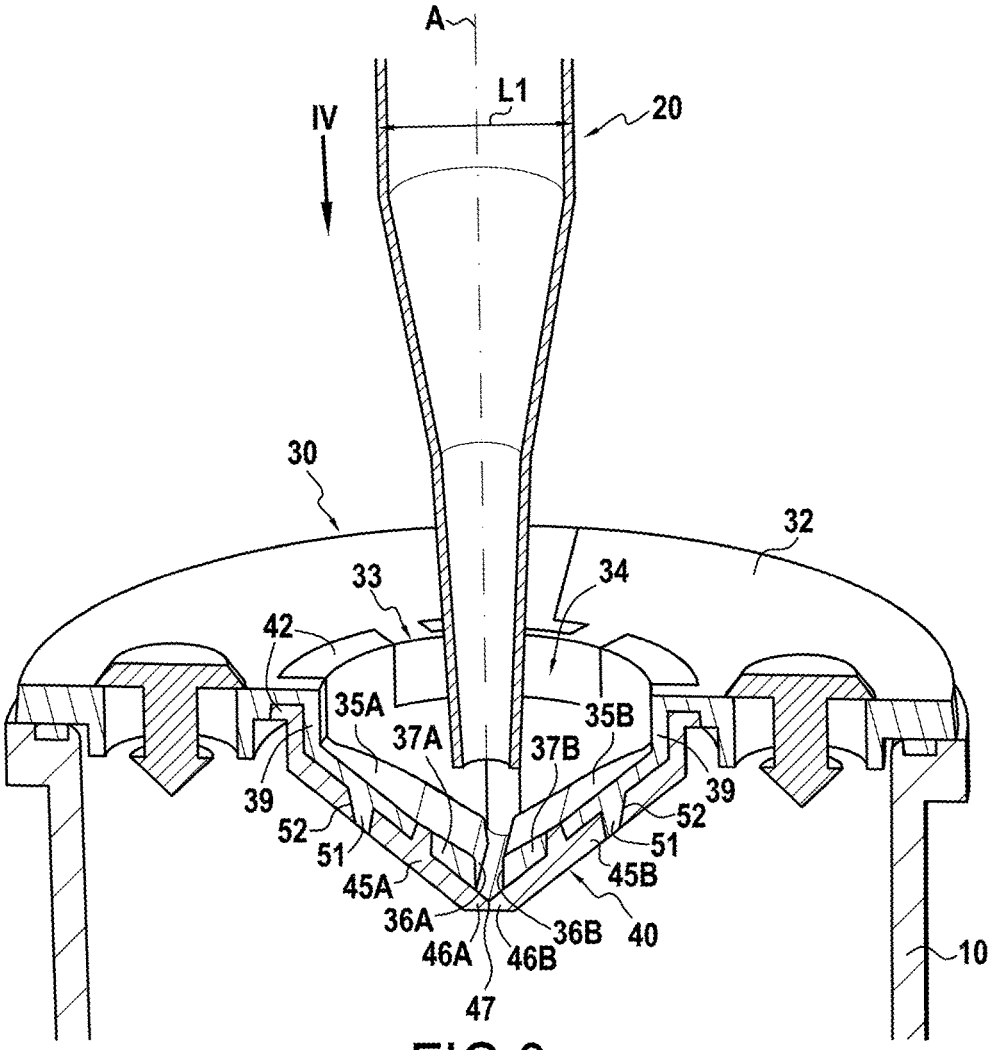
FIG. 3 shows the cap of FIG. 2, in perspective and cross-sectional view along plane III-III, with the transfer member of FIG. 1 situated just above the membrane of the cap.

The cap 30 is passed through an opening 34. The opening 34 is adapted to in turn be passed through by the tip 20. The cap 30 also comprises a membrane 40 which, when it is not passed through by the tip 20, i.e. when it is "at rest," covers the opening 34, as shown in FIG. 3.

The membrane 40 has a main portion that extends through the opening 34 and defines two inclined faces 45A, 45B. This main portion is surrounded by a peripheral rim 42 through which the membrane 40 is connected to the body 32 of the cap. For example, the membrane 40 is welded to the body 32.

Each inclined face 45A, 45B of the membrane 40 has a distal edge 46A, 46B and the two inclined faces form a dihedron when the membrane 40 is at rest, the distal edges 46A, 46B of the two inclined faces 45A, 45B coming together at the apex 47 of the dihedron.

The cap 30 also comprises two flaps 35A, 35B that extend through the opening 34, above the membrane 40. The two inclined faces 45A, 45B are respectively covered by the two flaps 35A, 35B. Each flap 35A, 35B has a substantially trapezoidal shape, a dovetail in the example. The narrowest side of the flap is connected to the body 32 of the cap by a hinge 39, and the widest side corresponds to the distal edge, or free edge, of the flap.

Each flap 35A, 35B extends substantially as far as the apex 47 of the dihedron and has a substantially rectilinear free edge 36A, 36B that extends along the apex 47 of the dihedron, so that, when the tip 20 passes through the opening 34, the free edges 36A, 36B of the two flaps respectively press along the distal edges 46A, 46B of the two inclined faces. Thus, when the tip 20 penetrates the opening 34, the free edges 36A, 36B space the two inclined faces 46A, 46B apart, and the membrane 40 tears along the apex 47 of the dihedron.

The choice of a component material of the membrane 40, for example a flexible elastomer, and the reduced thickness of said membrane 40, for example between 0.3 and 0.8 mm, at the apex 47, allow the membrane 40 tear easily under pressure from the tip 20.

The tip 20 has a transverse section with width Ll. The tip 20 having, in the example, a circular transverse section and being slender (its section decreasing distally), the width L1 corresponds to the maximum diameter of the tip portion intended to pass through the opening 34. Said width L1 is referenced in FIGS. 3 and 4. This width L1 is smaller than the width L3 of the apex 47 of the dihedron, referenced in FIG. 4.

Figure 4:
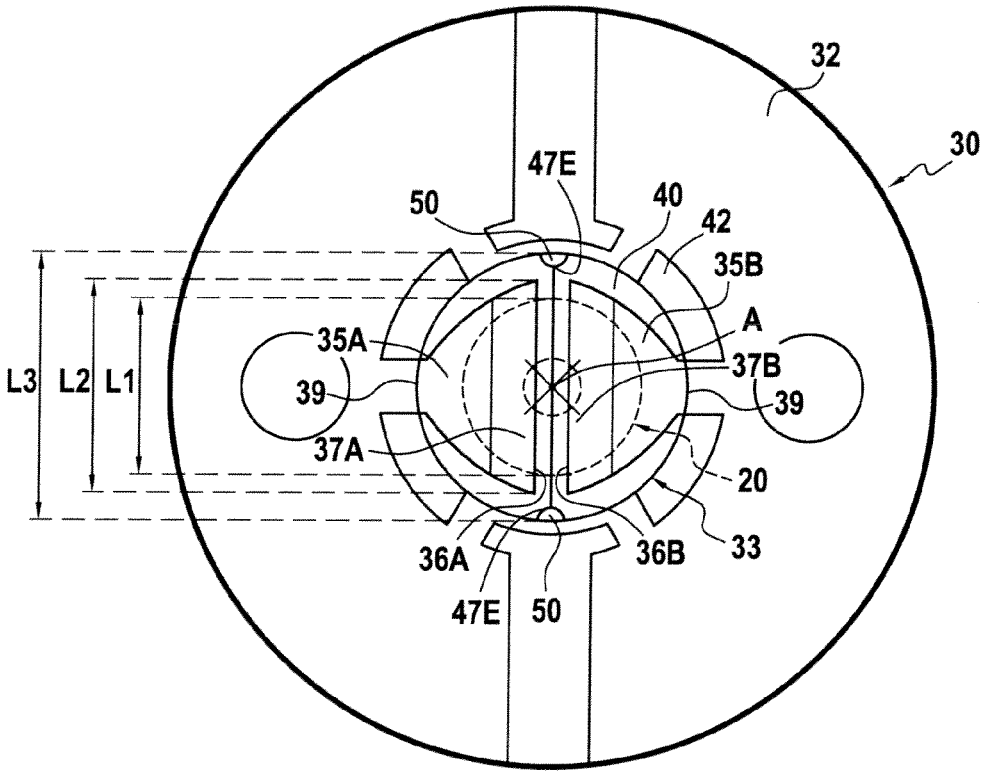
FIG. 4 is a top view, along arrow IV, of the cap and the transfer member of FIG. 3.

The free edges 36A, 36B of the flaps have a length L2 comprised between the width L1 of the transverse section and the length L3 of the apex 47 (see FIG. 4). These free edges 36A, 36B being rigid enough, they move the distal edges 46A, 46B of the inclined faces apart over a length greater than the width L1 of the tip 20, when the tip 20 passes through the opening 34. This makes it easier for air to pass on each side of the tip 20 when the tip is introduced, when it is removed, and during the suction phase of the reagent. This avoids creating an overpressure/vacuum inside the container 10.

Each flap 35A, 35B has a lower surface facing the membrane 40 (i.e. facing downward in FIG. 3) and an upper surface opposite the lower surface (i.e. facing upward in FIG. 3).

On its upper surface, each flap has an overthickness 37A, 37B that extends along the free edge 36A, 36B of the flap.

Figure 5:
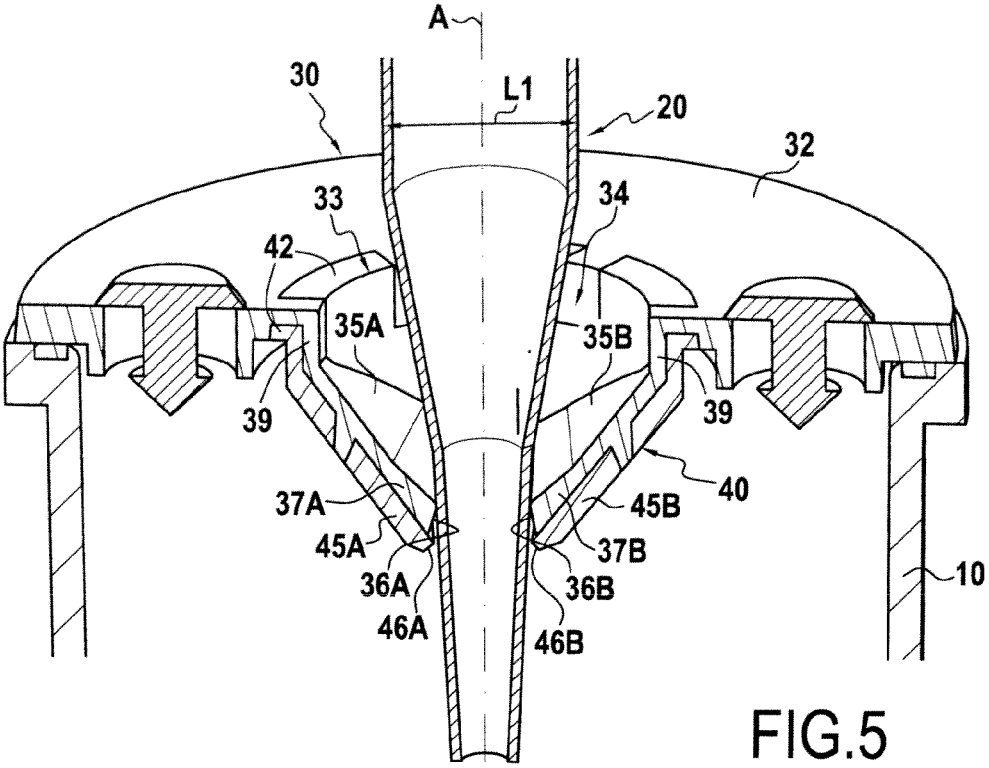
FIG. 5 is a cross-sectional view similar to that of FIG. 3, showing the transfer member, which passes through the membrane.

This overthickness 37A, 37B is formed, in the example, by an end portion of the flap 35A, 35B whereof the thickness increases continuously as one comes closer to the free edge 36A, 36B of the flap (see FIG. 3). In the example, the thickness of the flap 35A, 35B increases from a middle region of the flap, as far as the free edge 36A, 36B thereof. Owing to this overthickness 37A, 37B, the contact area between the tip 20 and each flap 35A, 35B is limited to the apex of the overthickness 37A, 37B, as shown in FIG. 5. Furthermore, this overthickness makes it possible to space the free edges 46A, 46B of the inclined faces even more widely apart from the membrane 40, during passage of the tip 20.

As shown in FIGS. 3 and 4, the opening 34 of the cap extends axially along a primary axis A, between an intake orifice 33, situated on the upper surface of the cap 30, and the main portion of the membrane 40. Furthermore, the apex 47 of the dihedron extends between two opposite ends 47E situated on the periphery of the opening 34.

The cap 30 comprises two guide elements 50 each extending on the periphery of the opening 34, between the intake orifice 33 and one of the two ends 47E of the apex 47, these guide elements 50 extending substantially parallel to the primary axis A.

When it is inserted in the opening 34, the tip 20 is guided toward the apex 47 by the flaps 35A, 35B, and toward the central part of the apex 47 by the guide elements 50. Thus, during its insertion, the tip 20 begins to tear the membrane 40 in the central part of the apex 47.

Each flap 35A, 35B has, on its lower surface (i.e. the surface facing the membrane 40), protuberances 51 formed in the example by spurs and housed in cavities 52 provided in the inclined faces 45A, 45B of the membrane 40. These cavities 52 have a shape complementary to that of the spurs. Owing to these protuberances 51 and cavities 52, the flaps 35A, 35B and the membrane 40 are physically connected and the flaps 35A, 35B follow the movements of the membrane 40 and vice versa. Of course, other types of mechanical connection making it possible to achieve a similar result could be considered. For example, the flaps 35A, 35B could be adhered on the membrane 40.

The flaps 35A, 35B are connected to the body 32 by hinges 39, i.e. by articulation areas. Each hinge 39 is made from a rigid material (generally the same material as that of the flap 35A, 35B) and is configured to be elastically deformable so that the hinge 39 seeks to return it to its original shape when the tip 20 is removed. In this way, when the tip 20 is removed, the hinges 39 pull the flaps 35A, 35B upward. Combined with the fact that the membrane 40 (made from a flexible elastic material) also seeks to return naturally to its original shape (i.e. its shape at rest) due to its elastic properties, this allows the membrane 40 to return to its original shape after removing the tip 20. In particular, the width of the slit created along the apex decreases to ideally become zero.

The choice of component materials of the membrane 40, the flaps, and the hinges 39, as well as the physical connection between the flaps 35A, 35B and the membrane 40, therefore allow the membrane to return to its original shape after removing the tip 20. This makes it possible to preserve the sealing of the container 10 and, therefore, to increase the lifetime of the reagent after the first use of the container.

Figure 6:
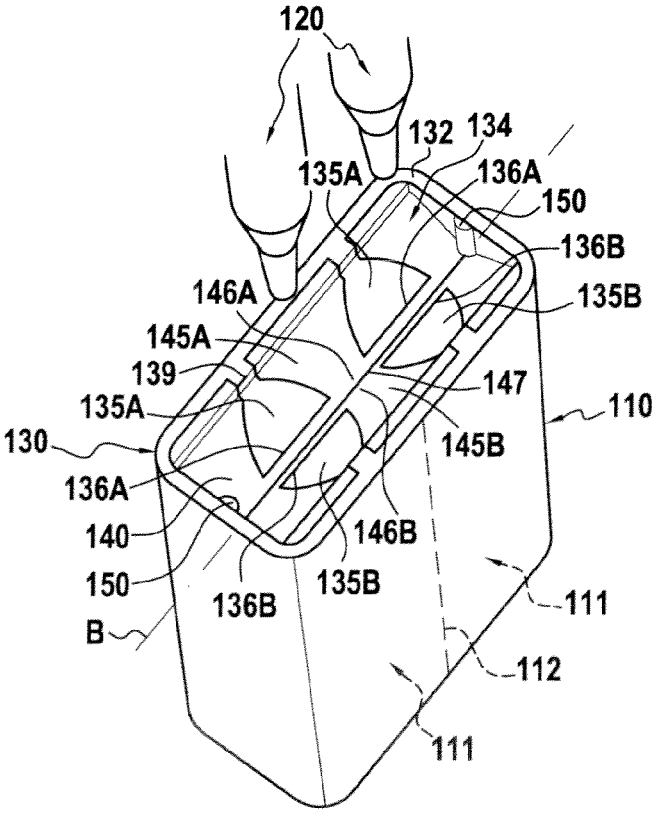
FIG. 6 shows, in perspective view, another example of a container closed by a cap with several transfer members situated outside the container, above the cap.

Another example of a system comprising a container 110 and a cap 130 is shown in FIG. 6. The cap 130 closes the upper space of the container 110. This example differs from that of the previous figures in that the opening 134 of the cap 130 closing the container 110 is not circular, but oblong, said opening 134 extending lengthwise along an axis B. The apex 147 of the dihedron, formed by the inclined faces 145A, 145B of the membrane 140 at rest, also extends along the axis B or parallel to said axis. The container 110 also has an elongated shape along the axis B and comprises one or more reagents. The container 110 can have two compartments 111 separated by a partition 112. These two compartments 111 can comprise identical or different reagents.

Furthermore, the system comprises two tips 120. These tips 120 make it possible to remove the reagent(s) contained in the container 110. To that end, the tips 120 are lowered through the cap 130.

A pair of flaps 135A, 135B is associated with each tip 120. There are therefore two pairs of flaps in all, two flaps being referenced 135A and two other flaps 135B. The flaps 135A, 135B are similar to the flaps 35A, 35B previously described. In particular, the flaps 135A, 135B of a same pair extend through the opening 134, above the membrane 140. The inclined face 145A of the membrane 140 is covered by two flaps 135A, i.e. by one flap 135A of each pair, and the inclined face 145B is covered by two flaps 135B, i.e. by one flap 135B of each pair. Each flap 135A, 1356 has a free edge 136A, 136B that extends along the distal edge 146A, 146B of the corresponding inclined face 145A, 145B.

The tips 120 are positioned facing each pair of flaps 135A, 1356, so that each tip 120 cooperates with the two flaps 135A, 135B of a same pair, in the same way the tip 20 of FIGS. 1 to 5 cooperates with the flaps 35A, 35B. In this way, when the two tips 120 pass through the opening 134 and the membrane 140, the free edges 136A, 136B of the flaps respectively push along the distal edges 146A, 1466 of the two inclined faces of the membrane.

The embodiments or examples described herein are given by way of illustration and not limitation. One skilled in the art can easily, in light of this description, modify these embodiments or examples, or consider others, while remaining within the scope of the invention.

Furthermore, the various features of these embodiments or examples can be used alone or in combination. When they are combined, these characteristics can be combined as described above or differently, the invention not being limited to the specific combinations described herein. In particular, unless otherwise indicated, a feature described in relation with one embodiment or example can be applied similarly to another embodiment or example.

The invention claimed is:

1. A cap comprising:

a body, an opening passing through the cap and adapted in turn to be passed through by at least one product transfer member, and a membrane which, at rest, covers the opening, wherein the membrane has a main portion that extends through the opening and defines two inclined faces, each inclined face having a distal edge, and wherein the two inclined faces form a dihedron when the membrane is at rest, the distal edges of the two inclined faces coming together at the apex of the dihedron, wherein said cap comprises at least two flaps extending through the opening, above the membrane, the two inclined faces of the membrane being respectively covered by the two flaps, each flap having a free edge that extends along the distal edge of the corresponding inclined face, so that, when the transfer member passes through the opening and the membrane, the free edges of the two flaps respectively press along the distal edges of the two inclined faces, wherein each flap has a lower surface facing the membrane and an upper surface opposite the lower surface, wherein the lower surface of each flap includes at least a first geometric feature having a first configuration, wherein corresponding inclined faces of the membrane include at least a second geometric feature having a second configuration complementary to the first configuration, and wherein an entirety of the first or second geometric features is enclosed by the other of the first and second geometric features.

2. The cap according to claim 1, wherein each flap has, on its upper surface, an overthickness that extends along the free edge of the flap.

3. The cap according to claim 2, wherein the overthickness is formed by a portion of the flap whose thickness increases continuously as one comes closer to the free edge.

4. The cap according to claim 1, wherein the opening extends axially between an intake orifice and a main portion of the membrane, and wherein the apex of the dihedron has two opposite ends, the cap comprising two guide elements respectively extending between the intake orifice and the two opposite ends of the apex, at a periphery of the opening.

5. The cap according to claim 1, wherein the membrane is made from a first material and the flaps from a second material that is more rigid than the first material.

6. The cap according claim 1, wherein the membrane is made from a first material and the flaps from a second material, different from the first material and such that a coefficient of friction of the transfer member on the second material is lower than a coefficient of friction of the transfer member on the first material.

7. The cap according to claim 1, wherein the membrane is pierceable and/or tearable along the apex of the dihedron.

8. The cap according to claim 1, wherein the distal edges of the inclined faces and the free edges of the flaps are substantially parallel to one another.

9. The cap according to claim 1, wherein the distal edges of the inclined faces and the free edges of the flaps are substantially rectilinear.

10. A system comprising a cap according to claim 1 and a container, the cap closing the container.

11. The system according to claim 10, further comprising a product transfer member configured to pass through the opening and the membrane and to transfer a product from an inside area toward an outside area of the container, or vice versa.

12. The system according to claim 11, wherein the transfer member has a transverse section with a width smaller than a length of the distal edges of the inclined faces, and wherein the free edges of the flaps have a length comprised between the width of the transverse section and the length of the distal edges.

* * * * *